US009090957B2

(12) United States Patent
Amaya et al.

(10) Patent No.: US 9,090,957 B2
(45) Date of Patent: Jul. 28, 2015

(54) MARTENSITIC STAINLESS STEEL OIL COUNTRY TUBULAR GOOD

(75) Inventors: Hisashi Amaya, Osaka (JP); Kunio Kondo, Osaka (JP); Masakatsu Ueda, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1132 days.

(21) Appl. No.: 11/792,524

(22) PCT Filed: Dec. 7, 2004

(86) PCT No.: PCT/JP2004/018177

§ 371 (c)(1), (2), (4) Date: Mar. 28, 2008

(87) PCT Pub. No.: WO2006/061881

PCT Pub. Date: Jun. 15, 2006

(65) Prior Publication Data

US 2009/0098008 A1 Apr. 16, 2009

(51) Int. Cl.

| | |
|---|---|
| ***C22C 38/18*** | (2006.01) |
| ***C22C 38/00*** | (2006.01) |
| ***C21D 8/10*** | (2006.01) |
| ***C21D 9/08*** | (2006.01) |
| ***C22C 38/02*** | (2006.01) |
| ***C22C 38/20*** | (2006.01) |
| ***C22C 38/22*** | (2006.01) |

(Continued)

(52) U.S. Cl.

CPC . *C22C 38/00* (2013.01); *C21D 8/10* (2013.01); *C21D 8/105* (2013.01); *C21D 9/08* (2013.01); *C22C 38/001* (2013.01); *C22C 38/02* (2013.01); *C22C 38/18* (2013.01); *C22C 38/20* (2013.01); *C22C 38/22* (2013.01); *C22C 38/38* (2013.01); *C22C 38/58* (2013.01); *C21D 2211/008* (2013.01)

(58) Field of Classification Search

CPC ..... C22C 38/18

USPC ..... 420/34, 40, 60–61, 64, 67–69, 84, 89, 420/92–93, 119–121, 123–128; 148/325

See application file for complete search history.

(56) References Cited

U.S. PATENT DOCUMENTS 5,908,511 A 6/1999 Bianchi
5,985,209 A * 11/1999 Kimura et al. ..... 420/61

(Continued)

FOREIGN PATENT DOCUMENTS

EP 0 738 784 10/1996
EP 0 798 394 10/1997

(Continued)

*Primary Examiner* — Brian Walck
(74) *Attorney, Agent, or Firm* — Clark & Brody

(57) ABSTRACT

A martensitic stainless steel oil country tubular good contains, by mass, 0.005% to 0.1% C, 0.05% to 1% Si, 1.5% to 5% Mn, at most 0.05% P, at most 0.01% S, 9% to 13% Cr, at most 0.5% Ni, at most 2% Mo, at most 2% Cu, 0.001% to 0.1% Al, and 0.001% to 0.1% N, with the balance being Fe and impurities, and the pipe has a Cr-depleted region under the surface. The martensitic stainless steel oil country tubular good according to the present invention does not have a passive film on the surface and corrodes wholly at low speed. In addition, the Ni content is reduced, which allows uneven corrosion to be prevented. Therefore, SCC can be prevented from being generated in spite of the presence of a Cr-depleted region.

4 Claims, 2 Drawing Sheets

(51) Int. Cl.
*C22C 38/38* (2006.01)
*C22C 38/58* (2006.01)

(56) References Cited

U.S. PATENT DOCUMENTS

| | | | | |
|---|---|---|---|---|
| 6,129,999 | A * | 10/2000 | Ueda et al. | 428/683 |
| 2003/0044305 | A1 | 3/2003 | Miyazaki et al. | |
| 2003/0217789 | A1 | 11/2003 | Yoshizawa et al. | |
| 2004/0096352 | A1 | 5/2004 | Ozaki et al. | |

FOREIGN PATENT DOCUMENTS

| | | | | |
|---|---|---|---|---|
| EP | 1 661 655 | | 5/2006 | |
| JP | 08-311621 | | 11/1996 | |
| JP | 10-130785 | | 5/1998 | |
| JP | 11-61347 | | 3/1999 | |
| JP | 2000-080416 | | 3/2000 | |
| JP | 2002-121652 | | 4/2002 | |
| JP | 2002-146488 | | 5/2002 | |
| JP | 2003-129190 | | 5/2003 | |
| JP | 2003-183781 | | 7/2003 | |
| JP | 2003-193203 | | 7/2003 | |
| JP | 2003-193204 | | 7/2003 | |
| JP | 2003-253333 | | 9/2003 | |
| RU | 2 126 460 | | 2/1999 | |
| RU | 2 188 874 | | 9/2002 | |
| RU | 2 225 793 | | 3/2004 | |
| WO | 02/12592 | | 2/2002 | |
| WO | WO 03/033754 | A1 * | 4/2003 | C22C 38/00 |
| WO | 2005/023478 | | 3/2005 | |

* cited by examiner

MARTENSITIC STAINLESS STEEL OIL COUNTRY TUBULAR GOOD

TECHNICAL FIELD

The present invention relates to a martensitic stainless steel oil country tubular good, and more specifically to a martensitic stainless steel oil country tubular good for use in a wet carbon dioxide gas environment.

BACKGROUND ART

Petroleum and natural gas produced from oil wells and gas wells contain corrosive gas such as carbon dioxide gas and hydrogen sulfide gas. In such a wet carbon dioxide gas environment, martensitic stainless steel pipes having high corrosion resistance are used as oil country tubular goods. More specifically, 13Cr stainless steel pipes, typically API13Cr steel pipes are widely used. The 13Cr stainless steel pipe is resistant to carbon dioxide gas corrosion as it contains about 13% Cr and martensitic in structure as it contains about 0.2% C.

In recent years, deeper oil and gas wells have been explored and developed. An oil country tubular good (hereinafter, simply referred to as OCTG) for use in a deep well in a wet carbon dioxide environment must have a high strength equal to 655 MPa or more and high toughness. In a wet carbon dioxide gas environment at high temperatures in the range from 80° C. to 150° C., there is a concern that an active path corrosion type stress corrosion cracking (hereinafter simply as "SCC") may be generated, and therefore high SCC resistance is requested.

The following disadvantages are encountered when a 13Cr stainless steel pipe is used in a deep well in a high temperature wet carbon dioxide gas environment.

(1) For its high C content, necessary toughness cannot be obtained if the strength is raised to 655 MPa or more.

(2) The 13Cr stainless steel pipe is subjected to quenching and tempering in the manufacturing process, and Cr carbides 50 are formed in the structure after the tempering as shown in FIG. 1. A Cr-depleted region 60 as a low Cr content region forms in the periphery of the Cr carbide 50 or at a grain boundary. The Cr-depleted region 60 increases the SCC susceptibility. Therefore, the 13Cr stainless steel pipe having the Cr-depleted region 60 does not have SCC resistance necessary for use in a deep well in a high temperature wet carbon dioxide environment.

This is why the super 13Cr martensitic stainless steel pipe usable in a deep well in a high temperature wet carbon dioxide environment has been developed. The super 13Cr martensitic stainless steel pipe has higher SCC resistance than that of the 13Cr stainless steel pipe because of a passive film on the surface formed by adding an alloy element such as Mo and Cu and its C content set to 0.1% or less. This is because almost no Cr carbide is precipitated in the structure after the tempering for the low C content as shown in FIG. 2, provided that the tempering condition is properly set.

Since a large quantity of Ni as an austenite-forming element is contained in place of C that is also an austenite-forming element, the martensitic structure can be kept, even if the C content is low. Therefore, the super 13Cr martensitic stainless steel pipe has high strength and toughness necessary for use in a high temperature wet carbon dioxide gas environment.

The conventional 13Cr martensitic stainless steel pipe is subjected to quenching and tempering in order to obtain desired strength, but a 13Cr martensitic stainless steel pipe produced without the tempering following rolling (hereinafter referred to as "tempering-omitted martensitic stainless steel pipe") has been developed for reducing the manufacturing cost. The tempering-omitted martensitic stainless steel pipe is disclosed by JP 2003-183781 A, JP 2003-193203 A, and JP 2003-129190 A. According to these publications, desired strength and toughness can be obtained, even if the tempering is omitted.

However, the inventors have found through examinations that the tempering-omitted martensitic stainless steel pipe has SCC resistance lower than that of the conventional super 13Cr martensitic stainless steel pipe. As shown in FIG. 3, a Cr-depleted region is not produced on the inner side than a region about as deep as 100 μm from the surface of the tempering-omitted martensitic stainless steel pipe, but a Cr-depleted region 60 is generated in a region from the surface to a depth of about 100 μm.

The Cr-depleted region 60 under the surface forms after hot working. More specifically, the Cr-depleted region 60 forms when mill scales form after rolling and Cr under the surface is absorbed in the mill scales, or a Cr carbide 50 forms under the surface because of graphite used as a lubricant for the rolling, so that the Cr-depleted region 60 forms around the Cr carbide 50. The conventional super 13Cr martensitic stainless steel pipe is subjected to tempering after rolling, and therefore such a Cr-depleted region 60 under the surface is eliminated during the tempering process, but the tempering-omitted martensitic stainless steel pipe is produced without being subjected to the tempering, and therefore many Cr-depleted regions 60 should be left unremoved under the surface.

The tempering-omitted martensitic stainless steel pipe disclosed by JP 2003-193204 A has high SCC resistance. However, in the tests for evaluating the SCC resistance in the disclosure, a smooth test piece, i.e., a test piece having a polished surface was used. More specifically, the SCC resistance was not evaluated using a test piece including a Cr-depleted region under the surface. The inventors conducted SCC tests using test pieces including a Cr-depleted region under the surface according to the disclosed condition and found that the SCC resistance of the test pieces including a Cr-depleted region under the surface was lower than that of the smooth test piece.

Therefore, if the tempering-omitted martensitic stainless steel pipe including many Cr-depleted regions under the surface is used in a deep well in a high temperature wet carbon dioxide gas environment, SCC could be generated.

As a method of removing such Cr-depleted regions under the surface, shot-blasting and/or pickling may be carried out. These kinds of processing however increase the manufacturing cost. Even after these kinds of processing, there is still a possibility that Cr-depleted regions under the surface may remain unremoved depending on the processing condition.

DISCLOSURE OF THE INVENTION

It is an object of the present invention to provide a martensitic stainless steel OCTG having high SCC resistance in spite of the presence of a Cr-depleted region under the surface.

The inventors have found that if a passive film is not formed, the Ni content is not more than 0.5% by mass, and the Mn content is from 1.5% to 5% by mass, high SCC resistance results in spite of the presence of a Cr-depleted region under the surface. Hereinafter the requirements will be described.

(1) No passive film is formed.

The inventors considered that, in a wet carbon dioxide gas environment, SCC could be restrained by evenly corroding the overall surface at low corrosion rate without forming a passive film rather than restraining SCC by a passive film formed on the surface of the steel. When a passive film is formed, a part of the passive film could be destroyed by extraneous causes such as the impact of a wire and sand grains, chloride ions, or the like even if Mo or Cu is added to reinforce the passive film. As shown in FIG. 4, if a part of the passive film 2 of the martensitic stainless steel 1 is destroyed, the surface 3 removed of the passive film 2 serves as an anode, and the passive film 2 serves as a cathode. As a result, corrosive current concentrates at the surface 3 and local corrosion is more likely to be generated. More specifically, the SCC susceptibility increases. If the passive film 2 is not formed, the corrosive current can be prevented from concentrating, and therefore the local corrosion can be restrained. In a wet carbon dioxide gas environment, if the upper limit for the Cr content is 13% by mass, and the Mo content and the Cu content are each not more than 2% by mass, the passive film 2 is not formed.

(2) The Ni content is not more than 0.5% by mass.

Even without a passive film, if a large dissolution amount region and a small dissolution amount region are formed on the surface of the steel from a microscopic point of view, the surface could be corroded in an uneven manner. If the uneven corrosion advances, SCC could be generated at the boundary between the large dissolution amount region and the small dissolution amount region.

The inventors therefore immersed a plurality of martensitic stainless steel pieces having Cr-depleted regions in a chloride aqueous solution (NaCl) in a saturated concentration, and examined about the relation between metal ions eluted from the steel and the dissolution amount of the surface of the steel. Multiple kinds of martensitic stainless steel whose Cr content is from 9% to 13% and Mo content and Cu content are not more than 2% with no passive film were used. The Ni content was changed among the different kinds of steel.

As the result of examination, the inventors have newly found that if no passive film is formed and the Ni content is not more than 0.5% by mass, SCC can be prevented from being generated if a Cr-depleted region exists under the surface.

With reference to FIG. 5, the surface of the martensitic stainless steel with no passive film is uniformly corroded. At the time, Fe ions and Cr ions eluted from the surface of the steel lower the pH of the solution. Therefore, the pH of the solution on the surface regions 10 and 11 where the Fe ions and the Cr ions are eluted is lowered.

Meanwhile, Ni ions eluted from the surface restrain the pH of the solution from being lowered. Therefore, the pH of the solution on the surface regions 12 and 13 where Ni ions are eluted is higher than the pH of the solution on the surface regions 10 and 11. Therefore, as shown in FIG. 6, the dissolution amount of the surface regions 12 and 13 is small and the dissolution amount of the surface regions 10 and 11 is large. As a result, corrosion advances at the surface regions 10 and 11, and the surface is unevenly corroded. If the corrosion proceeds unevenly from a microscopic point of view, SCC is more likely to be generated at the boundary between the large dissolution amount region and the small dissolution amount region as in the region 15.

In the martensitic stainless steel as described above with no passive film, uneven corrosion proceeds because of Ni and SCC is generated. In short, the SCC susceptibility depends more on the Ni content than on the Cr-depleted region. If therefore the Ni content is reduced, local corrosion can be prevented in spite of the presence of Cr-depleted regions under the surface, and SCC can be prevented from being generated.

(3) The Mn content is from 1.5% to 5.0% by mass.

Since Ni can cause SCC and therefore its content is preferably reduced. However, if the content of Ni as an austenite forming element is reduced, martensite as well as δ ferrite is formed. The δ ferrite not only lowers the strength and toughness of the steel but also can generate an SCC originated from the interphase between the martensite and the ferrite. Therefore, instead of reducing the Ni content, the content of Mn also as an austenite forming element may be increased to restrain the δ ferrite from being formed, so that SCC starting from the interphase can be prevented.

In consideration of the above, the inventors completed the following invention.

A martensitic stainless steel OCTG according to the invention contains, by mass, 0.005% to 0.1% C, 0.05% to 1% Si, 1.5% to 5% Mn, at most 0.05% P, at most 0.01% S, 9% to 13% Cr, at most 0.5% Ni, at most 2% Mo, at most 2% Cu, 0.001% to 0.1% Al, and 0.001% to 0.1% N, with the balance being Fe and impurities, and the pipe has a Cr-depleted region under the surface.

In this case, the Cr-depleted region under the surface is a part having a Cr concentration of 8.5% or less by mass in the steel and such regions are scattered for example in a region from the surface to a depth of less than 100 μm toward the inside of the steel. The Cr-depleted region is for example formed in the periphery of a Cr carbide or at a grain boundary. The Cr-depleted region is specified for example by the following method. A thin film sample is produced from an arbitrary part in a region from the surface to a depth of less than 100 μm to the inside of the martensitic stainless steel OCTG. The thin film sample is for example produced by focused icon beam (FIB) processing equipment. The thin film sample material is observed using a transmission electron microscope (TEM) and the Cr concentration of the observed region is analyzed by an energy dispersive X-ray spectrometer (EDS) mounted at the TEM, so that the presence of a Cr region can be determined.

The martensitic stainless steel OCTG according to the invention does not have a passive film formed on the surface in a high temperature wet carbon dioxide gas environment. The Ni content that can cause a cathode to form is limited. Therefore, as shown in FIG. 7, in the martensitic stainless steel OCTG according to the invention, local corrosion can be prevented from being generated in a high temperature wet carbon dioxide gas environment in spite of the presence of a Cr-depleted region under the surface, the overall surface is evenly corroded at low speed. The content of Mn, an austenite forming element like Ni is increased, so that the structure can be made martensitic, and generation of δ ferrite can be restrained. Therefore, SCC originated from the interphase can be prevented. Consequently, the martensitic stainless steel OCTG according to the invention has high SCC resistance.

The martensitic stainless steel OCTG according to the invention preferably further contains at least one of 0.005% to 0.5% Ti, 0.005% to 0.5% V, 0.005% to 0.5% Nb, 0.005% to 0.5% Zr.

In this case, each of these elements combines with C in the steel to form a fine carbide. Therefore, the toughness of the steel is improved. Note that the addition of these elements does not affect the SCC resistance.

The martensitic stainless steel OCTG according to the invention preferably further contains at least one of 0.0002% to 0.005% B, 0.0003% to 0.005% Ca, 0.003% to 0.005% Mg, and 0.0003% to 0.005% of a rare earth element.

In this case, each of these added elements improves the hot workability of the steel. Note that these elements do not affect the SCC resistance.

BEST MODE FOR CARRYING OUT THE INVENTION

Figure 1:
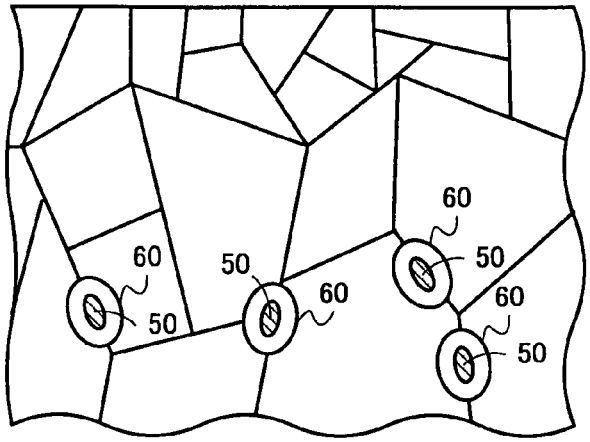
FIG.1 PRIOR ART
FIG. 1 is a schematic view showing the concept of the structure of 13Cr stainless steel.
Figure 2:
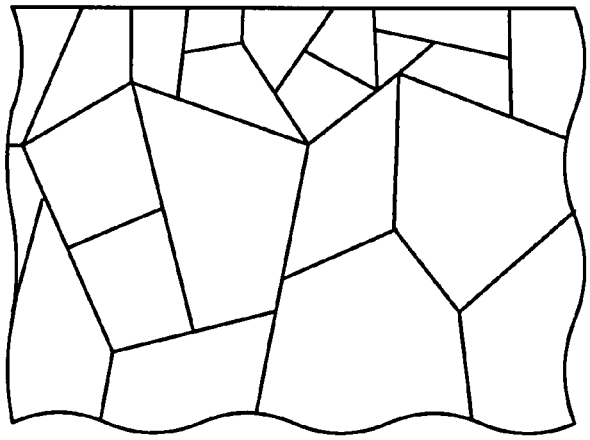
FIG.2 PRIOR ART
FIG. 2 is a schematic view showing the concept of the structure of super 13Cr martensitic stainless steel.
Figure 3:
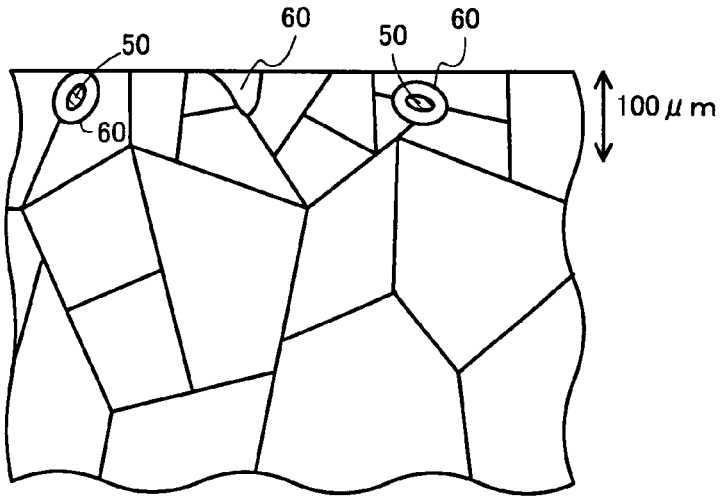
FIG. 3 is a schematic view showing the concept of the structure of tempering-omitted martensitic stainless steel.
Figure 4:
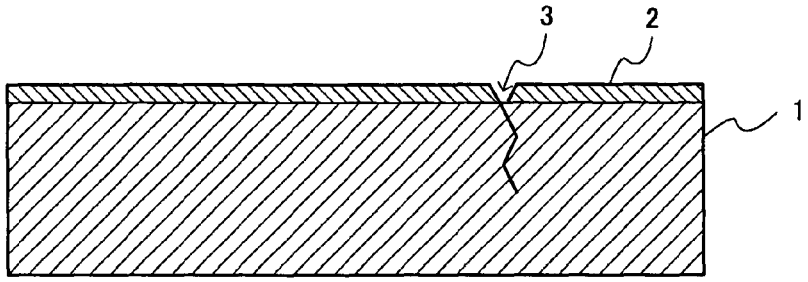
FIG. 4 is a schematic view for use in illustrating the concept of how an SCC is generated in martensitic stainless steel having a passive film formed thereon.
Figure 5:
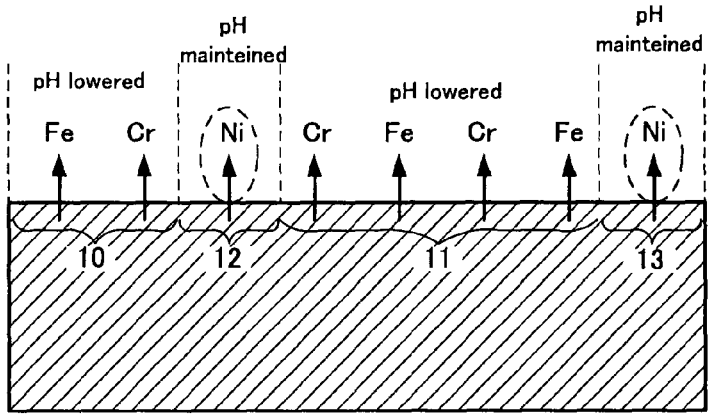
FIG. 5 is a view showing the concept of how steel containing Ni and Cr is corroded in an initial stage.
Figure 6:
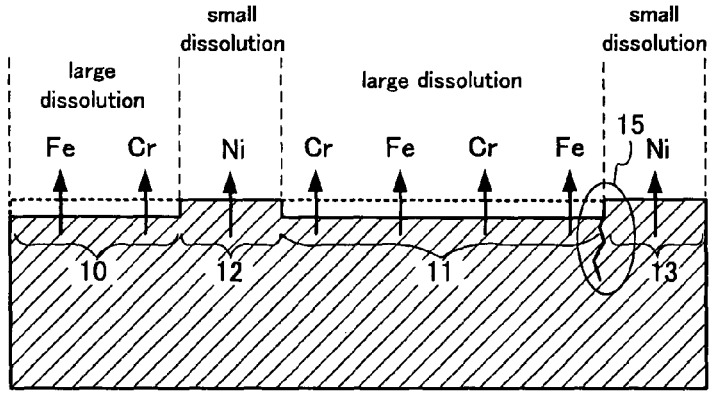
FIG. 6 is a view showing the concept of how steel containing Ni and Cr is corroded.
Figure 7:
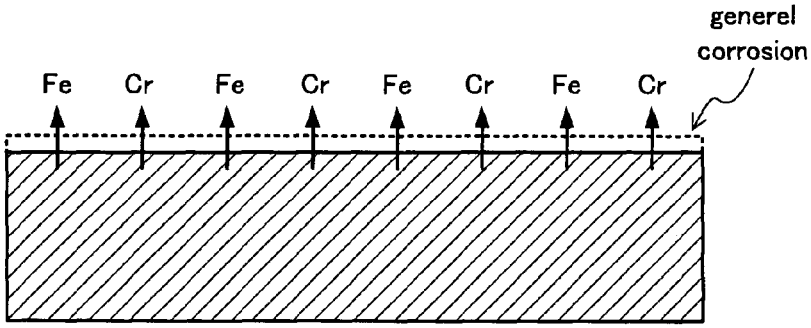
FIG. 7 is a view showing the concept of how a martensitic stainless steel OCTG according to the invention is corroded.

Now, an embodiment of the invention will be described in detail.

1. Chemical Composition

The martensitic stainless steel pipe according to the embodiment of the invention has the following composition. Hereinafter, "%" related to elements means "% by mass."

C: 0.005% to 0.1%

Carbon contributes to improvement in the strength of the steel. On the other hand, if the C content is excessive, a Cr carbide is excessively precipitated and an SCC is originated from the Cr carbide. Therefore, the C content is in the range from 0.005% to 0.1%, preferably from 0.01% to 0.07%, more preferably from 0.01% to 0.05%.

Si: 0.05% to 1%

Silicon is effectively applied to deoxidize the steel. On the other hand, Si is a ferrite forming element and therefore an excessive Si content causes δ ferrite to be generated, which lowers the toughness of the steel. Therefore, the Si content is from 0.05% to 1%.

Mn: 1.5% to 5%

Manganese is an austenite forming element and contributes to formation of a martensitic structure. The content of Ni that is also an austenite-forming element is reduced according to the invention, and therefore the Mn content is preferably increased in order to make the steel structure martensitic and obtain higher strength and toughness.

Furthermore, Mn contributes to improvement in SCC resistance. Manganese can restrain δ ferrite from being generated and prevent an SCC from being originated from the interphase between δ ferrite and martensite.

On the other hand, an excessive Mn content lowers the toughness. Therefore, the Mn content is from 1.5% to 5%, preferably from 1.7% to 5%, more preferably from 2.0% to 5%.

P: 0.05% or less

Phosphorus is an impurity. Phosphorus that is a ferrite forming element produces δ ferrite and lowers the toughness of the steel. Therefore, the P content is preferably as low as possible. The P content is 0.05% or less, preferably 0.02% or less.

S: 0.01% or less

Sulfur is an impurity. Sulfur that is a ferrite forming element produces δ ferrite in the steel and lowers the hot workability of the steel. Therefore, the S content is preferably as low as possible. The S content is 0.01% or less, preferably 0.005% or less.

Cr: 9% to 13%

Chromium contributes to improvement in corrosion resistance in a wet carbon dioxide gas environment. Chromium can also slow down the corrosion rate when the overall surface of the steel is corroded. On the other hand, Cr is a ferrite forming element and an excessive Cr content causes δ ferrite to be generated, which lowers the hot-workability and toughness. Too much Cr also causes a passive film to be formed. Therefore, the Cr content is from 9% to 13%.

Ni: 0.5% or less

Nickel is an impurity according to the invention. As described above, Ni ions restrain the pH of the solution from being lowered and therefore lower the SCC resistance. Therefore, in the martensitic stainless steel pipe according to the embodiment, the Ni content is preferably as low as possible. Therefore, the Ni content is 0.5% or less, preferably from 0.25% or less, more preferably 0.1% or less.

Mo: 2% or less

Cu: 2% or less

The martensitic stainless steel OCTG according to the invention has no passive film formed and the overall surface is corroded at low corrosion rate. Molybdenum and copper serve to stabilize and enhance a passive film, and therefore the Mo and Cu contents are preferably as low as possible. Therefore, the Mo and Cu contents are both 2% or less. Preferably, the Mo content is 1% or less and the Cu content is 1% or less.

Al: 0.001% to 0.1%

Aluminum is effectively applicable as a deoxidizing agent. On the other hand, an excessive Al content increases nonmetal inclusions in the steel, which lowers the toughness and corrosion resistance of the steel. Therefore, the Al content is from 0.001% to 0.1%.

N: 0.001% to 0.1%

Nitrogen is an austenite forming element and restrains δ ferrite from being generated, thus making the structure of the steel martensitic. On the other hand, too much N excessively increases the strength and lowers the toughness. Therefore, the N content is 0.001% to 0.1%, preferably from 0.01% to 0.08%.

Note that the balance consists of Fe and impurities.

The martensitic stainless steel pipe according to the embodiment further contains at least one of Ti, V, Nb, and Zr if required. Now, a description will be provided about these elements.

Ti: 0.005% to 0.5%

V: 0.005% to 0.5%

Nb: 0.005% to 0.5%

Zr: 0.005% to 0.5%

These elements each couple with C to produce a fine carbide and improve the toughness of the steel. The elements also restrain a Cr carbide from being generated, and therefore the amount of Cr solid solution is prevented from decreasing. If the content of each of these elements is set to the range from 0.005% to 0.5%, these advantages can effectively be provided. Note that excessive addition of these elements increases the amount of carbides to be generated, which lowers the toughness of the steel.

The martensitic stainless steel OCTG according to the embodiment further includes at least one of B, Ca, Mg, and REM if required. Now, a description will be provided about these elements.

B: 0.0002% to 0.005%

Ca: 0.0003% to 0.005%

Mg: 0.0003% to 0.005%

REM: 0.0003% to 0.005%

Note that these elements contribute to improvement in the hot workability of the steel. If the contents of the elements are set to the above described ranges, the advantage can effectively be provided. Note that excessive contents of these elements lower the toughness of the steel and lowers the corrosion resistance in a corrosive environment. Therefore, the contents of these elements are all preferably in the range from 0.0005% to 0.003%, more preferably from 0.0005% to 0.002%.

2. Manufacturing Method

Molten steel having the above-described chemical composition is produced by blast furnace or electric furnace melting. The produced molten steel is subjected to degassing process. The degassing process may be carried out by AOD (Argon Oxygen Decarburization) or VOD (Vacuum Oxygen Decarburization). Alternatively, the AOD and VOD may be combined.

The degassed molten steel is formed into a continues casting material by a continuous casting method. The continues casting material is for example a slab, bloom, or billet. Alternatively, the molten steel may be made into ingots by an ingot casting method.

The slab, bloom, or ingot is formed into billets by hot working. At the time, the billets may be formed by hot rolling or by hot forging.

The billets produced by the continues casting or hot working are subjected to further hot working and formed into martensitic stainless steel pipes for oil well. Mannesmann process is employed as the hot working method. For example, Mannesmann mandrel mill process, Mannesmann plug mill process, Mannesmann pilger mill process, Mannesmann Assel mill process or the like may be performed. Alternatively, Ugine-Sejournet hot extrusion process may be employed as the hot working, while a forging pipe making method such as Ehrhardt method may be employed. The heating temperature during the hot working is preferably from 1100° C. to 1300° C. This is because if the heating temperature is too low, which makes the hot working difficult. If the temperature is too high, δ ferrite is generated, which degrades the mechanical properties or corrosion resistance. The finishing temperature for the material during the hot working is preferably from 800° C. to 1150° C.

The steel pipe after the hot working is cooled to room temperatures. The pipe may be cooled by air or water.

The steel pipe after the cooling is not subjected to tempering process. Note that after being cooled to room temperatures following the hot rolling, the steel pipe may be subjected to solution heat treatment. More specifically, after being cooled to room temperatures, the steel pipe is heated to 800° C. to 1100° C., heated for a prescribed period, and then cooled. The heating period is preferably from 3 to 30 minutes though not limited to the specific range. Note that after the solution heat treatment, tempering process is not carried out.

A Cr-depleted region forms under the surface of the martensitic stainless steel OCTG produced by the above-described steps, and a mill scale forms on the surface. The mill scale may be removed by shot blasting or the like.

Example 1

Sample materials having chemical compositions given in Table 1 were produced and examined for their strength, toughness, and SCC resistance.

TABLE 1

| Sample Materials | No. | Chemical Compositions (the balance is Fe and impurities, unit: % by mass) | | | | | | | | | | | | |
|---|---|---|---|---|---|---|---|---|---|---|---|---|---|---|
| | | C | Si | Mn | P | S | Cr | Ni | Al | N | Mo | Cu | Ti | V |
| Inv. Steel | 1 | 0.011 | 0.1 | 2.1 | 0.012 | 0.001 | 9.2 | 0.08 | 0.015 | 0.066 | 0.01 | 0 | 0 | 0 |
| | 2 | 0.011 | 0.1 | 2.1 | 0.012 | 0.001 | 9.2 | 0.08 | 0.015 | 0.066 | 0.01 | 0 | 0 | 0 |
| | 3 | 0.07 | 0.8 | 3.6 | 0.018 | 0.004 | 12.5 | 0.48 | 0.07 | 0.08 | 0.5 | 0.1 | 0 | 0 |
| | 4 | 0.03 | 0.2 | 4.9 | 0.011 | 0.001 | 10.3 | 0.13 | 0.018 | 0.07 | 1.3 | 1.5 | 0 | 0 |
| | 5 | 0.04 | 0.15 | 2.9 | 0.015 | 0.001 | 11.1 | 0.15 | 0.028 | 0.029 | 0.2 | 0.1 | 0 | 0 |
| | 6 | 0.08 | 0.7 | 3.2 | 0.013 | 0.001 | 12.9 | 0.07 | 0.044 | 0.05 | 1.8 | 0 | 0.015 | 0.05 |
| | 7 | 0.05 | 0.4 | 2.5 | 0.032 | 0.001 | 10.9 | 0.11 | 0.024 | 0.07 | 0.7 | 0.8 | 0.06 | 0 |
| | 8 | 0.01 | 0.15 | 1.7 | 0.011 | 0.002 | 9.8 | 0.38 | 0.022 | 0.08 | 0 | 1.6 | 0.02 | 0 |
| | 9 | 0.05 | 0.28 | 2.4 | 0.015 | 0.001 | 10.9 | 0.24 | 0.015 | 0.06 | 0.2 | 0.3 | 0 | 0 |
| | 10 | 0.01 | 0.12 | 3.8 | 0.012 | 0.001 | 11.8 | 0.44 | 0.03 | 0.05 | 0.1 | 0.3 | 0 | 0 |
| | 11 | 0.03 | 0.19 | 2.6 | 0.018 | 0.001 | 11.5 | 0.22 | 0.025 | 0.05 | 0.5 | 0.2 | 0.3 | 0.01 |
| Comp. Steel | 12 | *0.15 | 0.15 | *0.31 | 0.012 | 0.001 | 11.8 | 0.30 | 0.022 | 0.1 | 0 | 0 | 0 | 0 |
| | 13 | 0.07 | 0.18 | *0.9 | 0.011 | 0.001 | 12.3 | 0.37 | 0.025 | 0.07 | *2.2 | 0 | 0 | 0 |
| | 14 | 0.04 | 0.11 | 3.2 | 0.015 | 0.001 | 12.2 | *0.6 | 0.018 | 0.06 | 0 | 0 | 0 | 0 |
| | 15 | 0.03 | 0.18 | 3.9 | 0.013 | 0.001 | 12.8 | *1.2 | 0.012 | *0.15 | 0.9 | *2.1 | 0 | 0 |

| Sample Materials | No. | Chemical Compositions (the balance is Fe and impurities, unit: % by mass) | | | | | | conditions |
|---|---|---|---|---|---|---|---|---|
| | | Nb | Zr | B | Ca | Mg | REM | |
| Inv. Steel | 1 | 0 | 0 | 0 | 0 | 0 | 0 | as rolled |
| | 2 | 0 | 0 | 0 | 0 | 0 | 0 | solution heat treatment |
| | 3 | 0 | 0 | 0 | 0 | 0 | 0 | as rolled |
| | 4 | 0 | 0 | 0 | 0 | 0 | 0 | as rolled |
| | 5 | 0 | 0 | 0 | 0 | 0 | 0 | as rolled |
| | 6 | 0 | 0 | 0 | 0 | 0 | 0 | as rolled |
| | 7 | 0 | 0 | 0 | 0 | 0 | 0 | as rolled |
| | 8 | 0.01 | 0.01 | 0 | 0 | 0 | 0 | as rolled |

TABLE 1-continued

| | | | | | | | | |
|---|---|---|---|---|---|---|---|---|
| | 9 | 0 | 0 | 0 | 0.002 | 0 | 0 | as rolled |
| | 10 | 0 | 0 | 0.0019 | 0.003 | 0.001 | 0 | as rolled |
| | 11 | 0.2 | 0 | 0 | 0.0018 | 0.0007 | 0.002 | as rolled |
| Comp. | 12 | 0 | 0 | 0 | 0 | 0 | 0 | as rolled |
| Steel | 13 | 0 | 0 | 0 | 0 | 0 | 0 | as rolled |
| | 14 | 0 | 0 | 0 | 0 | 0 | 0 | as rolled |
| | 15 | 0 | 0 | 0 | 0 | 0 | 0 | as rolled |

*Outside the range of the invention

Steel having the chemical compositions given in Table 1 was melted. As shown in Table 1, the chemical compositions of the sample materials 1 to 11 were within the range of the chemical compositions according to the invention. The sample materials 1 and 2 have the same chemical composition. Meanwhile, in the sample materials 12 to 15, the content of any one of the elements is outside the range of the invention.

The molten steel from the sample materials 1 and 3 to 15 was cast into ingots. The produced ingots were heated for two hours at 1250° C., and then forged using a forging machine into round billets. The round billets were heated at 1250° C. for one hour, and the heated round billets are pierced and elongated by Mannesmann-mandrel mill process, so that a plurality of seamless steel pipes (oil country tubular goods) were formed. The seamless steel pipes after the elongating were cooled by air and formed into sample materials. Mill scales were attached to the inner surfaces of the air-cooled sample materials.

The sample material 2 was formed as follows. Steel having the chemical composition given in Table 1 was formed into molten steel, and then made into seamless steel pipes by the same process as those carried out to the other sample materials. Then, the seamless steel pipes were subjected to solution heat treatment. More specifically, the seamless steel pipes were heated at 1050° C. for 10 minutes, and then the heated seamless steel pipes were rapidly cooled.

In each of the sample materials, some of the plurality of produced seamless steel pipes were removed of mill scales on the inner surfaces by shot blasting. (Hereinafter the seamless steel pipes will be referred to as "descaled steel.") The other seamless steel pipes had the mill scales attached on their inner surfaces intact. (Hereinafter, these will be referred as "mill scaled steel.") In short, two kinds of seamless steel pipes were prepared from each of the sample materials.

The presence/absence of a Cr-depleted region under the inner surfaces of the mill scaled steel and the descaled steel was examined. More preferably, a thin film sample was produced from a part within 100 μm from the inner surface of the mill scaled steel using a focused ion beam machine (FIB). The thin film sample was observed using a transmission electron microscope (TEM), and the Cr concentration of the observed region was analyzed with a beam having a size of 1.5 nm emitted from an energy dispersive X-ray spectrometer (EDS) mounted at the TEM. As a result of the TEM observation, all the seamless steel pipes had a Cr-depleted region under their inner surfaces.

Using the produced sample materials, the strength and the SCC resistance of the sample materials were examined.

1. Strength Test

In order to examine the sample materials for their strength, a No. 4 tensile test piece based on JIS Z2201 was produced from each of the sample materials. Using the round rod tensile test pieces, tensile tests based on JIS Z2241 were carried out and their yield stresses (MPa) were obtained.

2. SCC Resistance Test

A four-point bend-beam specimen is produced each from the mill-scaled steel and the descaled steel of each of the sample materials and the specimens were subjected to stress corrosion cracking tests in a high temperature carbon dioxide gas environment.

The specimens each have a length of 75 mm, a width of 10 mm, and a thickness of 2 mm in the lengthwise direction of the seamless steel pipe, and one surface of each specimen (75 mm×10 mm) served as the inner surface of the steel pipe. In short, a specimen having a scaled surface (mill scaled surface) was produced from the mill scaled steel, and a specimen having a surface removed of the scale by shot blasting (descaled surface) was produced from the descaled steel.

The specimens were subjected to four-point bending tests. More specifically, 100% actual stress was applied on each specimen according to ASTM G39 method. At the time, tensile stress was applied on the mill scaled surface and the descaled surface. Thereafter, the specimens were immersed in a 25% NaCl aqueous solution having 30 bar $CO_2$ gas saturated therein and maintained at 100° C. The time for testing was 720 hours.

After the tests, a section of each of the specimens was examined for the presence/absence of crackings visually and by an optical microscope at 100 power. The chemical compositions of the surfaces were analyzed using an energy dispersive X-ray spectroscopy (EDX) device in order to determine the presence or absence of a passive film on the surfaces of the specimens after the tests, and compounds formed on the surfaces were subjected to X-ray analysis.

3. Test Results

Test results are given in Table 2. The unit of the yield stress in Table 2 is MPa. The "○" for the SSC corrosion resistance indicates that there was no cracking generated and "x" indicates that there was a cracking.

TABLE 2

| Sample | Yield | SCC Resistance | |
|---|---|---|---|
| Material No. | Stress (MPa) | Mill Scaled Steel | Descaled Steel |
| 1 | 862 | ○ | ○ |
| 2 | 883 | ○ | ○ |
| 3 | 952 | ○ | ○ |
| 4 | 917 | ○ | ○ |
| 5 | 814 | ○ | ○ |
| 6 | 896 | ○ | ○ |
| 7 | 876 | ○ | ○ |
| 8 | 834 | ○ | ○ |
| 9 | 883 | ○ | ○ |
| 10 | 827 | ○ | ○ |
| 11 | 862 | ○ | ○ |
| 12 | 1020 | x | x |
| 13 | 917 | x | x |
| 14 | 896 | x | x |
| 15 | 958 | x | x |

As can be seen, the sample materials 1 to 11 each had a yield stress higher than 758 MPa and had sufficient strength as an oil country tubular good though tempering process was omitted. Note that the sample material 2 subjected to solution heat treatment also had high strength.

The sample materials 1 to 11 were examined for their toughness, and the sample materials 6 to 8 containing at least one of Ti, V, Nb, and Zr had higher toughness than the sample materials 1 to 5. More specifically, the vTrs of the sample materials 6 to 8 is higher than the vTrs of the other sample materials by 10° C. or more.

The sample materials 1 to 11 after the pipe-making were visually observed for the presence/absence of defects, and it was found as a result that the sample materials 9 to 11 containing at least one of B, Ca, Mg, and REM had higher workability than the sample materials 1 to 8.

Furthermore, the scaled steel and the descaled steel of the sample materials 1 to 11 did not have crackings in the SCC resistance tests and had high SCC resistance. As a result of EDX and X-ray analysis after the SCC tests, no passive film was generated in the sample materials 1 to 11. More specifically, Cr-based and Fe-based amorphous materials probably generated by corrosion were found on the surfaces of the sample materials 1 to 11 after the SCC tests.

Meanwhile, the sample materials 12 to 15 had an SCC both in the scaled steel and the descaled steel. More specifically, the sample material 12 had its strength raised too much for its high C content and had an SCC that was probably caused by δ ferrite formation for its low Mn content. The sample material 13 had an SCC that was probably caused by an unstable passive film formed because of its high Mo content. The sample material 14 had an SCC because of its high Ni content. The sample material 15 had an SCC because of its high Ni, N, and Cu contents.

Although the present invention has been described and illustrated in detail, it is clearly understood that the same is by way of illustration and example only and is not to be taken by way of limitation. The invention may be embodied in various modified forms without departing from the spirit and scope of the invention.

The invention claimed is:

1. A tempering-omitted martensitic stainless steel seamless oil country tubular good, comprising, by mass, 0.005% to 0.1% C, 0.05% to 1% Si, 1.7% to 5% Mn, at most 0.05% P, at most 0.01% S, 9% to 13% Cr, at most 0.13% Ni, at most 2% Mo, at most 2% Cu, 0.001% to 0.1% Al, and 0.001% to 0.1% N, with the balance being Fe and impurities, said oil country tubular good having a Cr-depleted region under the surface, which is a part having a Cr concentration of 8.5% or less by mass in a region from a surface to a depth of less than 100 μm toward an inside of the tempering-omitted martensitic stainless steel seamless oil country tubular good.

2. The martensitic stainless steel seamless oil country tubular good according to claim 1, further comprising at least one of 0.005% to 0.5% Ti, 0.005% to 0.5% V, 0.005% to 0.5% Nb, and 0.005% to 0.5% Zr.

3. The martensitic stainless steel seamless oil country tubular good according to claim 1, further comprising at least one of 0.0002% to 0.005% B, 0.0003% to 0.005% Ca, 0.0003% to 0.005% Mg, and 0.0003% to 0.005% of a rare earth element.

4. The martensitic stainless steel seamless oil country tubular good according to claim 2, further comprising at least one of 0.0002% to 0.005% B, 0.0003% to 0.005% Ca, 0.0003% to 0.005% Mg, and 0.0003% to 0.005% of a rare earth element.

* * * * *